US007568249B1

(12) United States Patent
Kunde et al.

(10) Patent No.: US 7,568,249 B1
(45) **Date of Patent: *Aug. 4, 2009**

(54) BED FRAME ATTACHABLE TRANSFER BAR DEVICE

(76) Inventors: Michael F. Kunde, 1261 Shoal Ridge Rd., Oconomowoc, WI (US) 53066; Marie H. Kunde, 1261 Shoal Ridge Rd., Oconomowoc, WI (US) 53066

( * ) Notice: Subject to any disclaimer, the term of this patent is extended or adjusted under 35 U.S.C. 154(b) by 0 days.

This patent is subject to a terminal disclaimer.

(21) Appl. No.: 12/140,308

(22) Filed: Jun. 17, 2008

Related U.S. Application Data

(63) Continuation-in-part of application No. 11/702,921, filed on Feb. 6, 2007, now Pat. No. 7,467,434.

(60) Provisional application No. 60/772,714, filed on Feb. 13, 2006.

(51) Int. Cl.
*A47C 21/00* (2006.01)
*A47C 21/08* (2006.01)

(52) U.S. Cl. ..... 5/662; 5/424; 5/428

(58) Field of Classification Search ..... 5/662, 5/424, 428–430
See application file for complete search history.

(56) References Cited

U.S. PATENT DOCUMENTS 3,021,534 A 2/1962 Hausted
3,863,282 A * 2/1975 Stillwell ..... 5/503.1
5,384,927 A * 1/1995 Mardero et al. ..... 5/662
6,012,182 A * 1/2000 Allen et al. ..... 5/81.1 R
6,039,293 A * 3/2000 Minet ..... 248/125.8
6,728,985 B2 5/2004 Brook et al.
6,986,177 B2 * 1/2006 Thaxton ..... 5/81.1 R
7,467,434 B1 * 12/2008 Kunde et al. ..... 5/662

* cited by examiner

*Primary Examiner*—Michael Trettel
(74) *Attorney, Agent, or Firm*—Donald J. Ersler

(57) ABSTRACT

A bed frame attachable transfer bar device preferably includes a rail attachment member, a turnbuckle, a second rail attachment member and a transfer bar. The rail attachment member includes a first lengthwise member and a first rail engagement member attached to one end of the first lengthwise member. The second rail attachment member includes a second lengthwise member attached to a transfer bar receiver and a second rail engagement member attached to the second lengthwise member and the transfer bar receiver. The rail attachment member is attached to the second rail attachment member with the turnbuckle. The transfer bar preferably includes a hand ring and a support post extending downward from the hand ring. The support post is sized to be received by the transfer bar receiver. A second embodiment of the transfer bar device is attached to bed frame rail with an L-shaped cross section.

18 Claims, 7 Drawing Sheets

BED FRAME ATTACHABLE TRANSFER BAR DEVICE

1. CROSS-REFERENCES TO RELATED APPLICATIONS

This is a continuation-in-part patent application, which takes priority from nonprovisional patent application Ser. No. 11/702,921, filed on Feb. 6, 2007 now U.S. Pat. No. 7,467,434, which takes priority from provisional application No. 60/772,714, filed on Feb. 13, 2006.

BACKGROUND OF THE INVENTION

1. Field of the Invention

The present invention relates generally to providing assistance for getting in and out of a bed, and more specifically to a bed frame attachable transfer bar device, which greatly reduces the risk of injury or death from entrapment.

2. Discussion of the Prior Art

There are numerous transfer bars in the art that aid in getting infirm, disabled and elderly people in and out of bed. A poorly designed transfer device can result in the injury and death to people trying to get out of a bed. U.S. Pat. No. 3,021,534 to Hausted discloses adjustable bed rails. The Hausted patent includes a pair of fences that are adjustable attached to frame rails of a bed. U.S. Pat. No. 6,728,985 to Brooke et al. discloses an ambulatory assist arm apparatus. The Brooke et al. patent includes an ambulatory assist arm apparatus for use with a patient support having a support surface and a frame, which includes a mounting bracket and body.

Accordingly, there is a clearly felt need in the art for a bed frame attachable transfer bar device, which is attachable to institutional and commercial bed frames and greatly reduces the risk of injury or death from entrapment due to a user trying to get out of a bed.

SUMMARY OF THE INVENTION

The present invention provides a bed frame attachable transfer bar device, which is attachable to bed frames. The bed frame attachable transfer bar device (transfer bar device) preferably includes a rail attachment member, a turnbuckle, a second rail attachment member and a transfer bar. The rail attachment member includes a first lengthwise member and a first rail engagement member attached to one end of the first lengthwise member. The second rail attachment member includes a second lengthwise member, a second rail engagement member and a transfer bar receiver. The second rail engagement member is attached to one end of the second lengthwise member. The transfer bar receiver is attached to the second rail engagement member and the second lengthwise member. The first and second rail engagement members are sized to receive an outer perimeter of most bed frame rails. The rail attachment member is attached to the second rail attachment member with the turnbuckle. A first fastener is secured to the other end of the rail attachment member and one end of the turnbuckle. A second fastener is secured to the other end of the second rail attachment member and the other end of the turnbuckle.

The transfer bar preferably includes a hand ring and a support post extending downward from the hand ring. The support post is sized to be received by the transfer bar receiver. At least one spring pin extends from the support post. A retention hole and an exit hole are formed through the transfer bar receiver to receive the at least one spring pin. The retention hole orients the hand ring, such that the hand ring is parallel with a side of the bed. The exit hole orients the hand ring, such that the hand ring is substantially perpendicular to the side of the bed. A second transfer bar receiver may be attached to the rail attachment member to retain a second transfer bar.

A second embodiment of a transfer bar device preferably includes two rail assemblies, the turnbuckle and at least one of the transfer bars. Each rail assembly includes a lengthwise member, a bracket engagement member, a transfer bar receiver and a support foot. If a length of the lengthwise member is insufficient, an extender tube is used to extend a length of the lengthwise member. The bracket engagement member is structured to retain a frame rail of a bed frame with an L-shaped cross section. The transfer bar receiver includes an inner perimeter that is sized to receive the support post of the transfer bar. A plurality of retention holes are formed through the transfer bar receiver for height adjustment of the transfer bar. The support foot includes a base support, a support post and a threaded bolt. The support post extends upward from the base support and the threaded bolt extends upward from a top of the support post.

One end of the lengthwise member is attached to a side of the transfer bar receiver at a bottom end thereof. The bracket engagement member is attached to a top of the lengthwise member and a side of the transfer bar receiver. A receiver threaded insert is retained in a bottom end of the transfer bar receiver for threadable engagement with the threaded bolt. One end of the extender tube is slipped over the other end of the lengthwise member and secured thereto. Each end of the turnbuckle is secured to the other end of one of the lengthwise members or to the other end of one of the extender tubes with fasteners. The support post of the transfer bar is inserted into the transfer bar receiver.

Accordingly, it is an object of the present invention to provide a transfer bar device, which is attachable to institutional bed frames.

It is a further object of the present invention to provide a transfer bar device, which is attachable to commercial bed frames.

Finally, it is another object of the present invention to provide a transfer bar device, which greatly reduces the risk of injury or death from entrapment.

These and additional objects, advantages, features and benefits of the present invention will become apparent from the following specification.

DETAILED DESCRIPTION OF THE PREFERRED EMBODIMENTS

Figure 1:
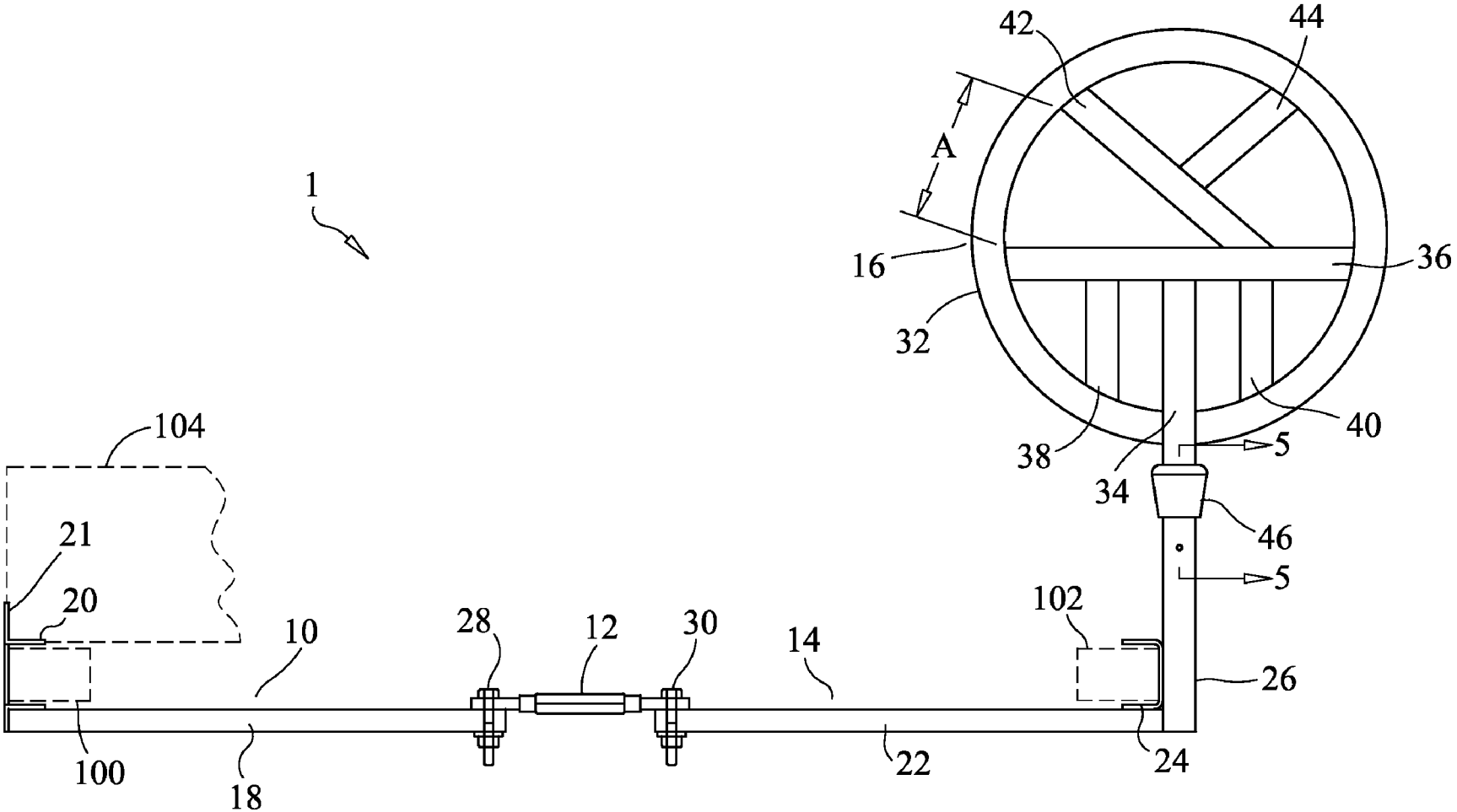
FIG. 1 is an end view of a transfer bar device retained on a bed frame with a hand ring in an exit position in accordance with the present invention.
Figure 2:
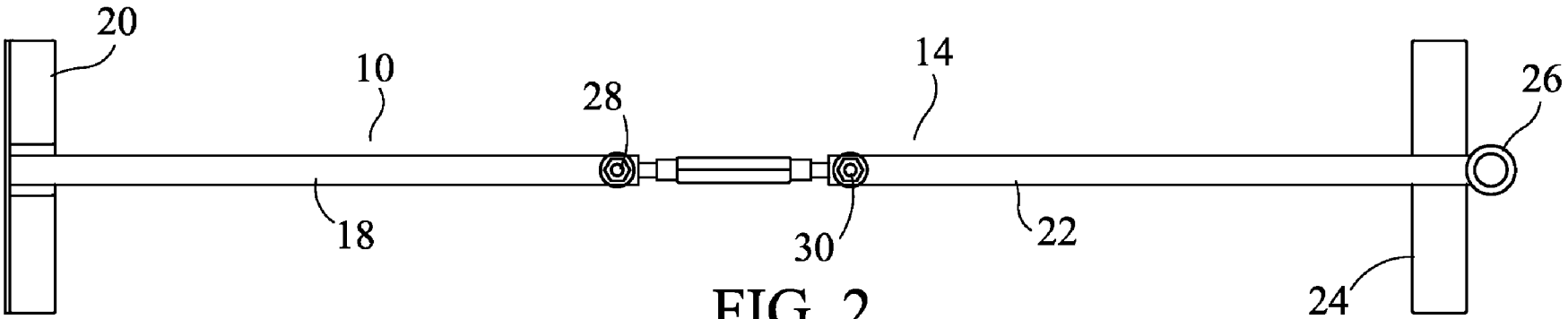
FIG. 2 is a top view of a transfer bar device with a transfer bar removed in accordance with the present invention.
Figure 3:
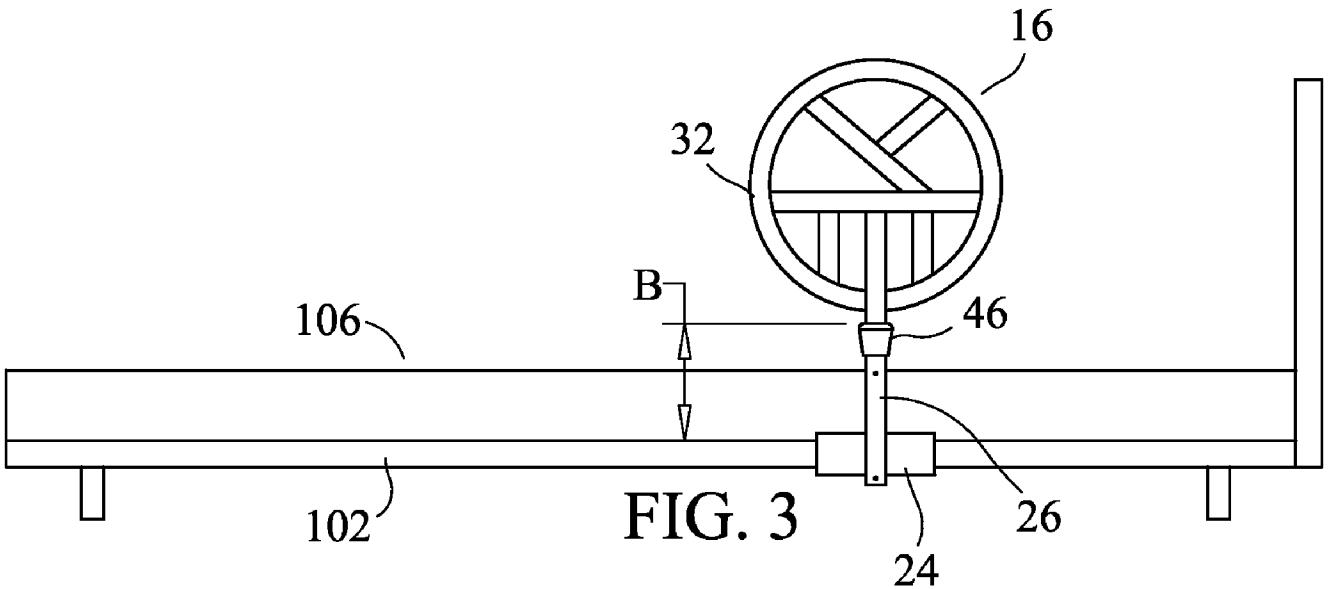
FIG. 3 is a side view of a transfer bar device attached to a bed frame in accordance with the present invention.
Figure 4:
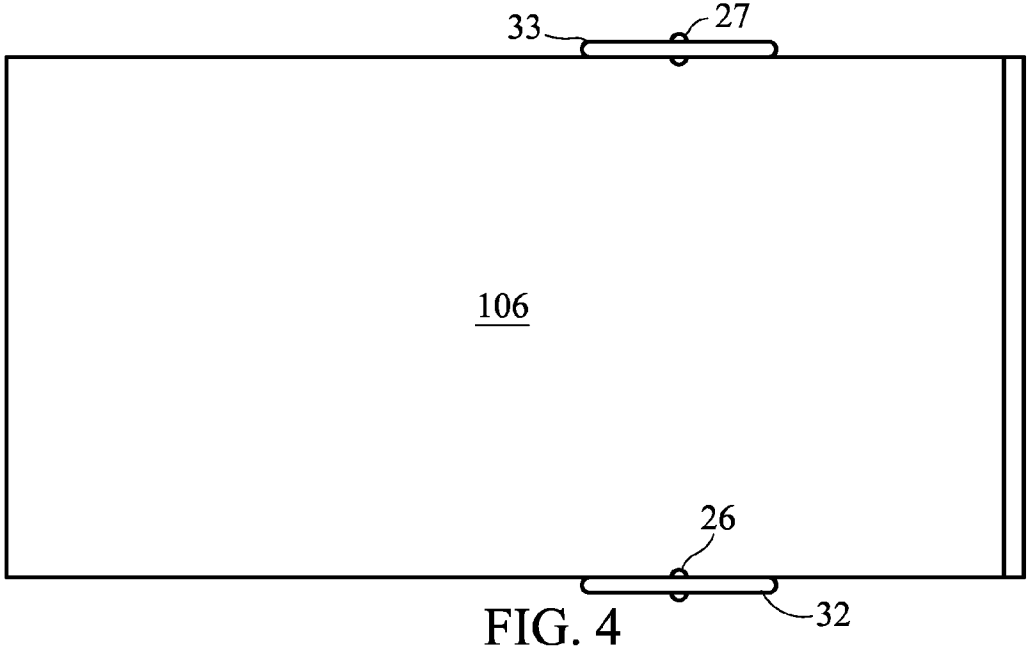
FIG. 4 is a top view of a transfer bar device attached to a bed frame with two transfer bars in accordance with the present invention.

With reference now to the drawings, and particularly to FIG. 1, there is shown an end view of a transfer bar device 1. With reference to FIGS. 2-4, the transfer bar device 1 preferably includes a rail attachment member 10, a turnbuckle 12, a second rail attachment member 14 and a transfer bar 16. The rail attachment member 10 includes a first lengthwise member 18 and a first rail engagement member 20. The first rail engagement member 20 is attached to one end of the first lengthwise member 18. The first rail engagement member 20 includes a U-shaped cross-section that is sized to receive an outer perimeter of a bed frame rail 100. A mattress stay 21 preferably extends from a top of the first rail engagement member 20. The mattress stay 21 prevents a mattress 104 from sliding relative to the first rail engagement member 20. The second rail attachment member 14 includes a second lengthwise member 22, a second rail engagement member 24 and a transfer bar receiver 26. The second rail engagement member 24 is attached to one end of the second lengthwise member 22. The second rail engagement member 24 includes a U-shaped cross-section that is sized to receive an outer perimeter of a bed frame rail 102.

The transfer bar receiver 26 is attached to the second rail engagement member 24 and the second lengthwise member 22. The first and second rail engagement members are sized to receive an outer perimeter of most bed frame rails. The rail attachment member 10 is attached to the second rail attachment member 14 with the turnbuckle 12. The turnbuckle 12 allows the distance between the inside of the first and second rail engagement members to be adjusted. A first fastener 28 is secured to the other end of the rail attachment member 10 and one end of the turnbuckle 12. A second fastener 30 is secured to the other end of the second rail attachment member 14 and the other end of the turnbuckle 12. However, other length adjustments devices besides the turnbuckle 12 may also be used.

The transfer bar 16 preferably includes a hand ring 32 and a support post 34. The support post 34 extends downward from the hand ring 32. The hand ring 32 is shown as having a substantially round shape, but could have any appropriate shape, such as an oval shape. A cross-tube 36 is preferably fastened in substantially a middle of the hand ring 32 to help support the hand ring 32. A first safety tube 38 and a second safety tube 40 are attached between the cross-tube 36 and an inner perimeter of the hand ring 32. The first and second safety tubes prevent chin entrapment. A first grasping tube 42 is attached between the cross bar 36 and an inside perimeter of the hand ring 32. A second grasping tube 44 is preferably attached between the cross bar 36 and the inside perimeter of the hand ring 32. The largest gap contained in the inner perimeter of the hand ring 32 cannot exceed a dimension "A" of 4¾ inches, according to federal regulations.

Figure 5:
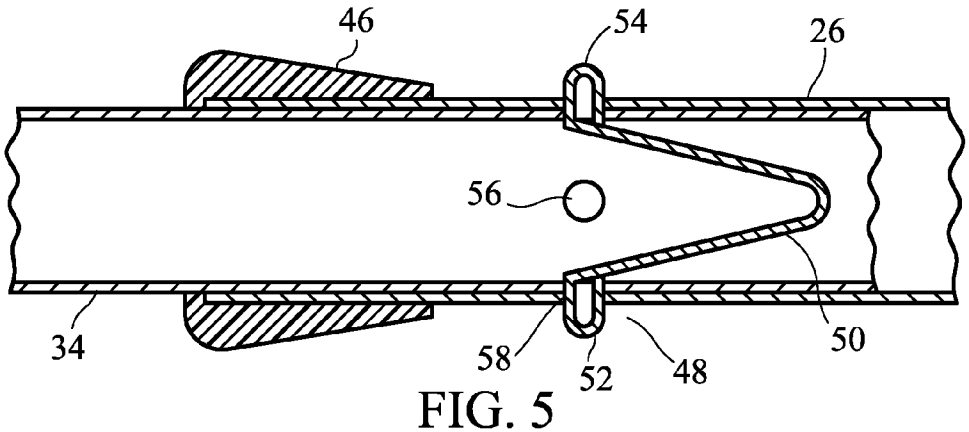
FIG. 5 is a cross-sectional view of a support post retained inside a transfer bar receiver illustrating a pair of spring pins of a transfer bar device in accordance with the present invention.
Figure 6:
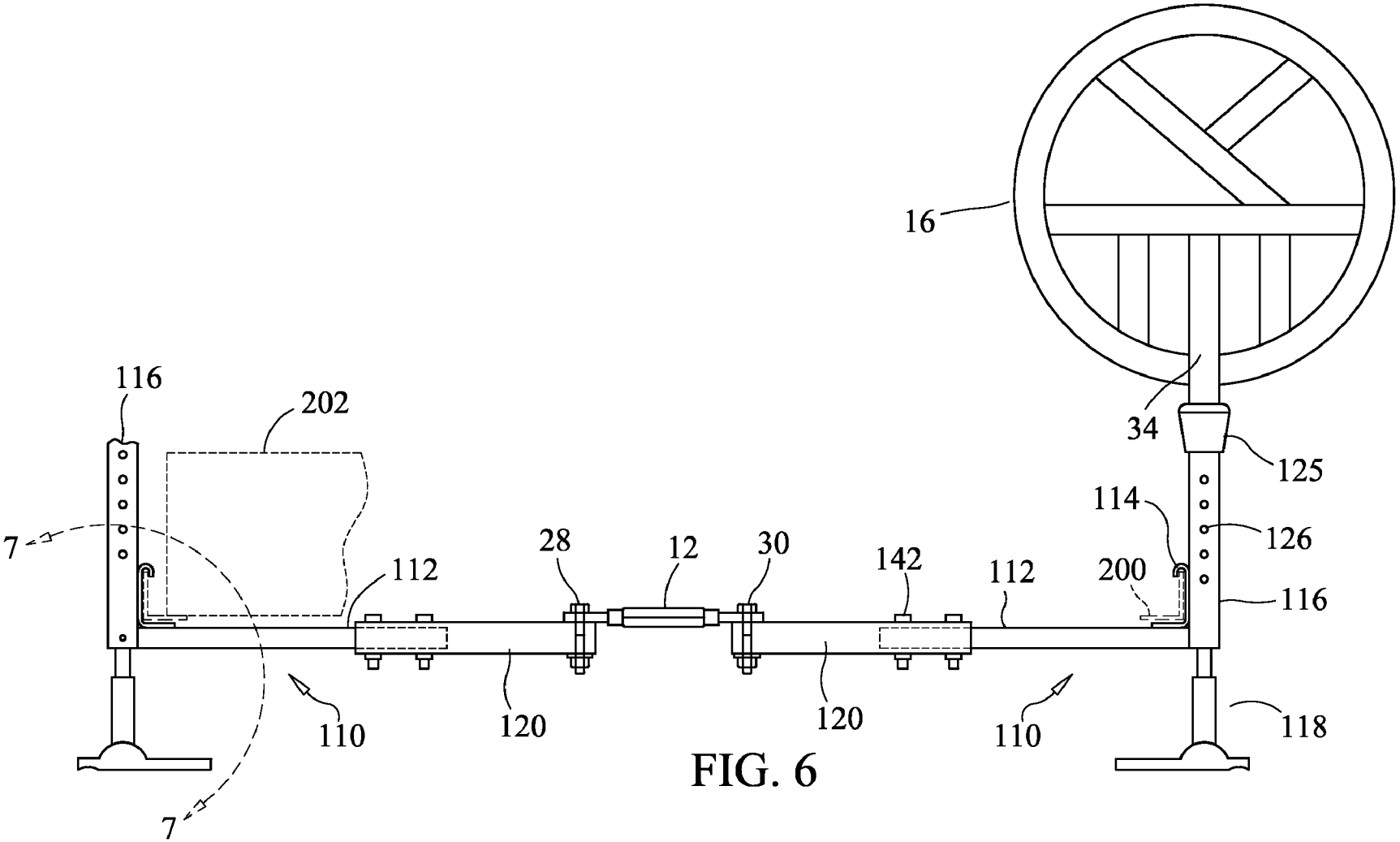
FIG. 6 is an end view of a second embodiment of a transfer bar device retained on a bed frame with a hand ring in an exit position in accordance with the present invention.
Figure 7:
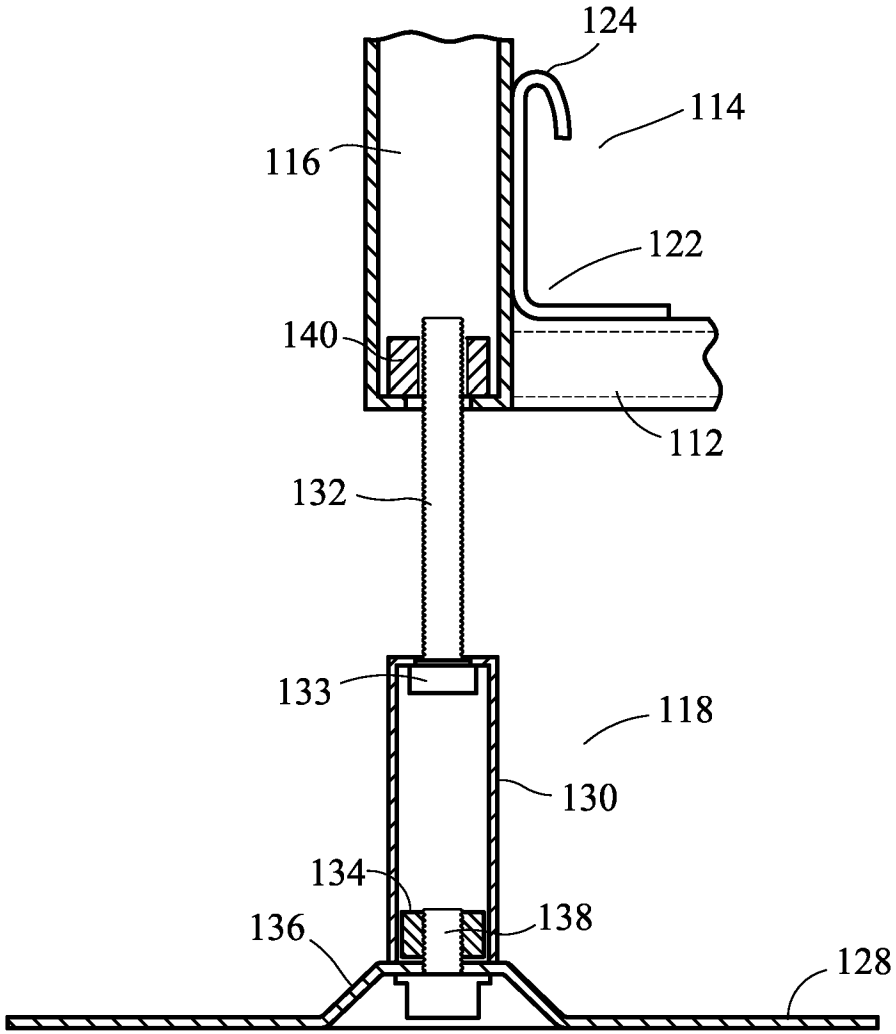
FIG. 7 is an enlarged portion of an end view of a second embodiment of a transfer bar device of FIG. 6 in accordance with the present invention.
Figure 8:
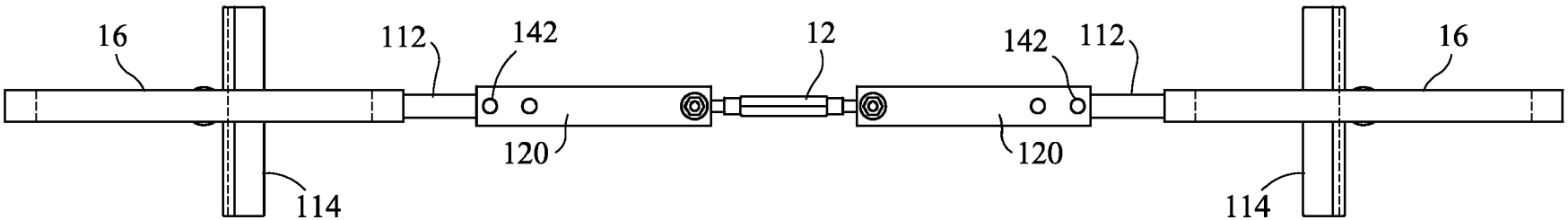
FIG. 8 is a top view of a second embodiment of a transfer bar device in accordance with the present invention.
Figure 9:
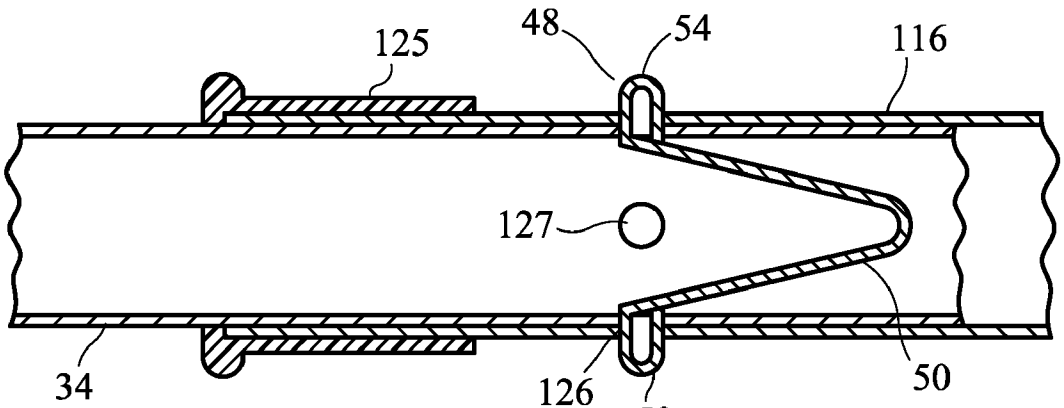
FIG. 9 is a cross-sectional view of a support post retained inside a transfer bar receiver illustrating a pair of spring pins of a second embodiment of a transfer bar device in accordance with the present invention.
Figure 10:
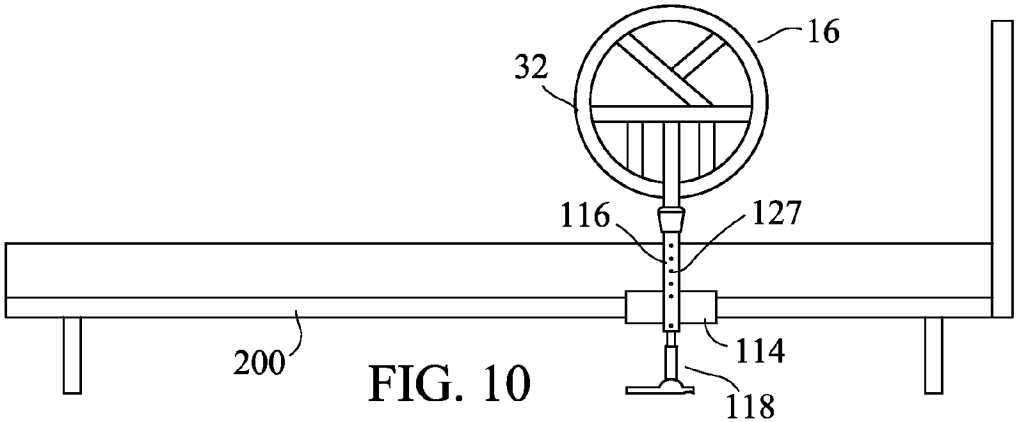
FIG. 10 is a side view of a second embodiment of a transfer bar device attached to a bed frame in accordance with the present invention.
Figure 11:
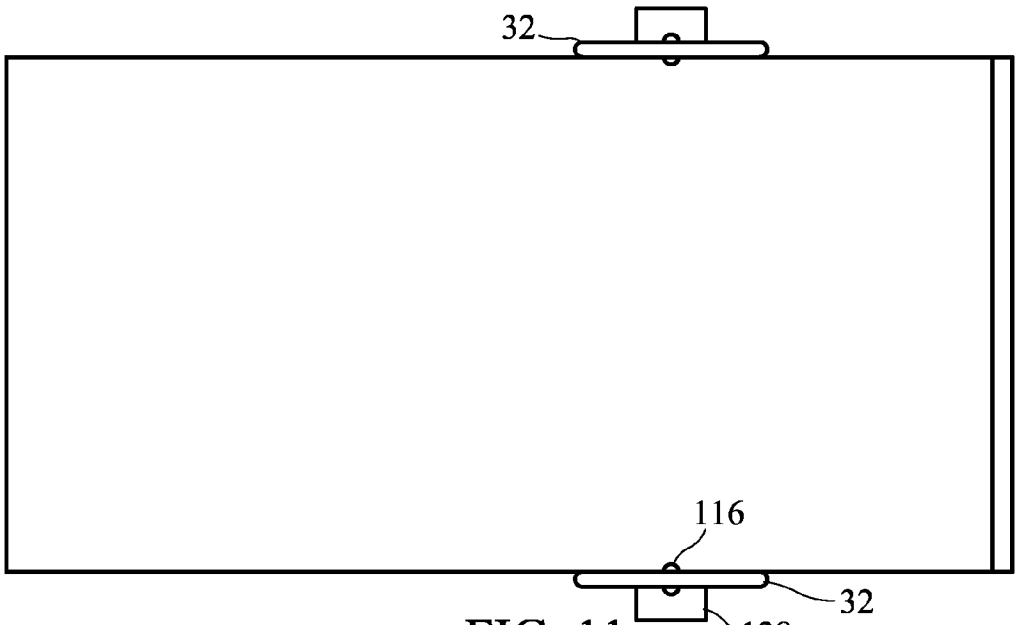
FIG. 11 is a top view of a second embodiment of a transfer bar device attached to a bed frame with two transfer bars in accordance with the present invention.

The support post 34 is sized to be received by an inner perimeter of the transfer bar receiver 26. With reference to FIG. 5, a protective boot 46 is preferably slipped over an end of the transfer bar receiver 26 for safety purposes. The dimension "B" from a top of the rail engagement members 20, 24 to a top of the protective boot 46 is preferably 5¼ inches. A spring pin insert 48 preferably includes a spring loaded body 50, a first spring pin 52 and a second spring pin 54. The spring loaded body 50 is biased, such that force must be applied to push the first and second spring pins against each other. A retention hole 56 and an exit hole 58 are formed through the transfer bar receiver 26 to receive the first and second spring pins. One design of spring pin insert 48 is shown, but other designs may also be used. The retention hole 56 orients the hand ring 32, such that the hand ring 32 is parallel with a side of the bed 106. The exit hole 58 orients the hand ring 32, such that the hand ring 32 is substantially perpendicular to the side of the bed 106. A second transfer bar receiver 27 may be attached to the rail attachment member 10 to retain a second transfer bar 33.

With reference to FIGS. 6-11, a second embodiment of a transfer bar device 2 preferably includes two rail assemblies 110, the turnbuckle 12 and at least one of the transfer bars 16. Each rail assembly 110 includes a lengthwise member 112, a bracket engagement member 114, a transfer bar receiver 116 and a support foot 118. If a length of the lengthwise member 112 is insufficient, an extender tube 120 is used to extend the length of the lengthwise member 112. An inner perimeter of the extender tube 120 is sized to receive an outer perimeter of the lengthwise member 112.

The bracket engagement member 114 includes an L-shaped member 122 and a downward facing hook 124. The downward facing hook 124 terminates a top of the L-shaped member 122. The downward facing hook 124 is sized to receive and retain a bed frame rail 200 with an L-shaped cross section. A pair of bed frame rails 200 support a box spring 202. The transfer bar receiver 116 includes an inner perimeter that is sized to receive the support post 34 of the transfer bar 16. A plurality of retention holes 126 are formed through the transfer bar receiver 116 for height adjustment of the transfer bar 16. A plurality of exit holes 127 are formed through the transfer bar receiver 116 substantially perpendicular to the plurality of retention holes 126. A height of the transfer bar 16 is adjusted by depressing the first and second spring pins 52, 54 and sliding the transfer bar 16 up and down relative to the transfer bar receiver 116. A protective boot 125 is preferably slipped over an end of the transfer bar receiver 116 for safety purposes.

The support foot 118 includes a base support 128, a support post 130 and a threaded bolt 132. The support post 130 includes a post threaded insert 134, which is retained in a bottom end. A bolt head 133 of the threaded bolt 132 is retained in a top end of the support post 130. A clearance pocket 136 is formed in the base support 128 to provide clearance for a fastener head 139 of a post fastener 138. The support post 130 is secured to the base support 128 by screwing the post fastener 138 into the post threaded insert 134. A height of the rail assembly 110 is adjusted by rotating the support foot 118 relative to the rail assembly 110.

One end of the lengthwise member 112 is attached to a side of the transfer bar receiver 116 at a bottom end thereof with welding or any other suitable method. The bracket engagement member 114 is attached to a top of the lengthwise member 112 and a side of the transfer bar receiver 116 with welding or any other suitable method. A receiver threaded insert 140 is retained in a bottom end of the transfer bar receiver 116 for threadable engagement with the threaded rod 132. One end of the extender tube 120 is slipped over the other end of the lengthwise member 112 and secured thereto with at least one fastener 142. Each end of the turnbuckle 12 is secured to the other end of one of the lengthwise members 112 or to the other end of one of the extender tubes 120 with fasteners 28, 30.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A bed frame attachable transfer bar device, comprising:

a first lengthwise member being structured to receive a first bed frame rail at one thereof;

a second lengthwise member being structured to receive a second bed frame rail at one thereof;

means for securing said first lengthwise member to said second lengthwise member;

means for supporting said one end of said first and second lengthwise members;

a transfer bar having a support post extending therefrom;

a transfer bar receiver being formed on said one end of at least one of said first and second lengthwise members, said transfer bar receiver being sized to receive said support post; and at least one spring pin extending from said support post, at least one retention hole and at least one exit hole being formed through said transfer bar receiver, said at least one retention hole being substantially perpendicular to said at least one exit hole.

2. The bed frame attachable transfer bar device of claim 1, further comprising:

a first bracket engagement member being located on said one end of said first lengthwise member to receive the first bed frame rail, a second bracket engagement member being located on said one end of said second lengthwise member to receive the second bed frame rail.

3. The bed frame attachable transfer bar device of claim 2, wherein:

said first and second bracket engagement member having an L-shaped member and a downward facing hook extending from a top of said L-shaped member.

4. The bed frame attachable transfer bar device of claim 1, wherein:

said means for joining said first and second lengthwise members being a turnbuckle.

5. The bed frame attachable transfer bar device of claim 1, further comprising:

said transfer bar including a hand ring, a cross tube and a support post, said cross tube being attached to substantially a middle of said hand ring, said support post being attached to said hand ring and said cross tube.

6. The bed frame attachable transfer bar device of claim 5, wherein:

said hand ring having a substantially round shape.

7. The bed frame attachable transfer bar device of claim 5, further comprising:

at least one safety tube being attached to said cross tube and said hand ring, at least one grasping tube being attached to said hand ring.

8. The bed frame attachable transfer bar device of claim 1, further comprising:

said means for supporting being a support foot disposed under said one end of said first and second lengthwise members, said support foot being vertically adjustable relative to said first and second lengthwise members.

9. A bed frame attachable transfer bar device, comprising:

a first lengthwise member being structured to receive a first bed frame rail at one thereof;

a second lengthwise member being structured to receive a second bed frame rail at one thereof;

means for securing said first lengthwise member to said second lengthwise member;

a transfer bar including a hand ring, a cross tube and a support post, said cross tube being attached to substantially a middle of said hand ring, said support post being attached to said hand ring and said cross tube;

a transfer bar receiver being formed on said one end of at least one of said first and second lengthwise members, said transfer bar receiver being sized to receive said support post; and a support foot being disposed under said one end of said first and second lengthwise members.

10. The bed frame attachable transfer bar device of claim 9, further comprising:

a first bracket engagement member being located on said one end of said first lengthwise member to receive the first bed frame rail, a second bracket engagement member being located on said one end of said second lengthwise member to receive the second bed frame rail.

11. The bed frame attachable transfer bar device of claim 10, wherein:

said first and second bracket engagement member having an L-shaped member and a downward facing hook extending from a top of said L-shaped member.

12. The bed frame attachable transfer bar device of claim 9, wherein:

said means for joining said first and second lengthwise members being a turnbuckle.

13. The bed frame attachable transfer bar device of claim 9, further comprising:

at least one spring pin extending from said support post, a retention hole and at least one exit hole being formed through said transfer bar receiver, said retention hole being substantially perpendicular to said at least one exit hole.

14. The bed frame attachable transfer bar device of claim 9, wherein:

an extension tube for extending a length of said first and second lengthwise members.

15. The bed frame attachable transfer bar device of claim 9, further comprising:

said support foot being vertically adjustable relative to said first and second lengthwise members.

16. A bed frame attachable transfer bar device, comprising:

a first lengthwise member and a second lengthwise member;

a first engagement bracket being disposed on one end of said first lengthwise member, said first engagement bracket receiving a first bed frame rail;

a second engagement bracket being disposed on one end of said second lengthwise member, said second engagement bracket receiving a second bed frame rail;

means for securing said first lengthwise member to said second lengthwise member;

a transfer bar having a support post extending therefrom;

a transfer bar receiver being formed on said one end of at least one of said first and second lengthwise members, said transfer bar receiver being sized to receive said support post; and at least one spring pin extending from said support post, at least one retention hole and at least one exit hole being formed through said transfer bar receiver, said at least one retention hole being substantially perpendicular to said at least one exit hole.

17. The bed frame attachable transfer bar device of claim 16, further comprising:

a support foot being disposed under said one end of said first and second lengthwise members, said support foot being vertically adjustable relative to said first and second lengthwise members.

18. The bed frame attachable transfer bar device of claim 16, further comprising:

said transfer bar including a hand ring, a cross tube and a support post, said cross tube being attached to substantially a middle of said hand ring, said support post being attached to said hand ring and said cross tube.

* * * * *